US005383568A

United States Patent [19]

Tusick et al.

[11] Patent Number: 5,383,568

[45] Date of Patent: Jan. 24, 1995

[54] METHOD AND ARTICLE FOR PACKAGING PAPER AND THE LIKE

[75] Inventors: Judith H. Tusick, Painesville; Kent D. Johnson, Sandusky, both of Ohio

[73] Assignee: Avery Dennison Corporation, Pasadena, Calif.

[21] Appl. No.: 759,833

[22] Filed: Sep. 13, 1991

Related U.S. Application Data

[63] Continuation of Ser. No. 459,941, Dec. 29, 1989, abandoned.

[51] Int. Cl.[6] ..... B65D 7/42

[52] U.S. Cl. ..... 220/606

[58] Field of Search ..... 220/339, 352, 353, 675, 220/671, 606; 229/902, DIG. 13, 2.5 R; 206/500, 509, 511, 449, 494, 215

[56] References Cited

U.S. PATENT DOCUMENTS

| | | | |
|---|---|---|---|
| 3,412,888 | 11/1968 | Andrews et al. | 206/508 X |
| 3,578,204 | 5/1971 | Bloch et al. | 220/72 |
| 3,710,975 | 1/1973 | Jansen | 220/339 |
| 3,726,395 | 4/1973 | Duhy | 206/449 |
| 3,730,739 | 5/1973 | Seiferth et al. | 206/449 X |
| 3,825,112 | 7/1974 | Schmaker et al. | 220/339 X |
| 3,937,389 | 2/1976 | Wind | 220/339 X |
| 4,060,173 | 11/1977 | Dahl | 220/339 X |
| 4,427,705 | 1/1984 | Wyslotsky et al. | 220/70 X |
| 4,498,589 | 2/1985 | Scott et al. | 206/449 X |
| 4,635,797 | 1/1987 | Bankier | 220/339 X |
| 4,718,550 | 1/1988 | Johnson | 220/339 X |
| 4,753,351 | 6/1988 | Guillin | 220/339 X |
| 4,754,874 | 7/1988 | Haney | 220/352 X |
| 4,863,054 | 9/1989 | Capetta | 220/339 X |
| 4,883,195 | 11/1989 | Ott et al. | 220/339 |
| 4,979,612 | 12/1990 | Melbye | 206/449 X |

*Primary Examiner*—Steven M. Pollard

*Attorney, Agent, or Firm*—Pearne, Gordon, McCoy & Granger

[57] ABSTRACT

A generally rectangular transparent and clear container for packing pressure-sensitive adhesive sheet stock which has a base and a cover that engage with each other with a snap action to establish a generally continuous closure around the perimeter of the container. The base has a raised bottom portion which has formed therein a series of spaced apart channels which are parallel to the end walls of the base, and a series of spaced apart channels which are parallel to the side walls of the base. A plurality of raised pads are formed between the channels which support the pressure sensitive adhesive sheet stock above a border channel which defines the perimeter of the base.

18 Claims, 2 Drawing Sheets

METHOD AND ARTICLE FOR PACKAGING PAPER AND THE LIKE

This is a continuation of application Ser. No. 07/459,941 filed Dec. 29, 1989, now abandoned.

BACKGROUND OF THE INVENTION

The invention relates to containers and methods for packaging and distributing paper, and more particularly to containers and methods for packaging and distributing pressure-sensitive adhesive (psa) paper sheet stock which is commonly used in printing of psa labels and the like in short low-volume runs by the offset process, as distinguished from printing by the flexographic process which usually employs psa paper roll stock and is associated with long high-volume runs.

PRIOR ART

Sheet stock coated with pressure-sensitive adhesive and provided with release liner to protect the adhesive, is commonly used by relatively small printers who utilize off-set printing techniques. Off-set printing techniques are of a nature where typically small runs are made achieving high quality results thereby satisfying the demands of specialty orders. For example, psa sheet stock is commonly used by small businesses for mailing labels, product identification, and bumper stickers.

The off-set printing industry is such that manufacturers of psa sheet stock package it in bundles containing, for example, a count of 100 or 200 sheets. The size of the sheet stock is typically 8½ by 11 inches. Typically a standard number of bundles, say ten, are then packed in a carton and shipped to a paper merchant. The paper merchant warehouses the paper stock, and sells it to printers on demand, breaking the cartons which are in inventory, and supplying what paper is required by a printer's order.

In the past, paper merchants typically delivered from the warehouse to printers. However, with increasing numbers of small print shops with relatively small paper requirements, it has been less and less practical for merchants to truck orders to all their printer customers. Therefore, there has been a trend for paper merchants to open up "cash and carry stores" centered in areas where there are quite a few small printers. The printers send their own personnel to such a store to pick up a carton or two. In this manner, the small printer market is becoming more and more like a retail market, where visibility, packaging and display become more important.

The psa sheet stock reaches the end user after being subjected by the printer to off-set printing, and often also to guillotining into several labels per sheet. Smaller printers are prone to use psa sheet stock because their orders are typically small and require high quality results. It is common for smaller printers to print specialty labels and signs on psa sheet stock and display them in their stores without the labels having been previously ordered by a particular customer. In this respect, consumers visit the printer's store to shop, i.e., to see what types of labels and other various signs are available before purchasing. This is even more clearly like a retail market, where visibility, packaging and display are important.

It is a practice in the industry to package the customary 100 count or 200 count bundles of psa sheet stock by either a polywrap or a cardboard box such as that used to package typing paper.

The polywrap is generally transparent, allowing the user to see the contents. However, once the polywrap is either wholely or partially removed from the bundle of psa sheet stock, it cannot be practically re-sealed nor can it be practically used for any subsequent re-packaging. Also, once the seal is broken on the polywrap, there is a continuous threat that the psa sheet stock will be exposed to moisture or other damage. These disadvantages may occur frequently because often printers only need part of a bundle to fulfill a particular job. The remainder of the bundle then sits open on the shelf.

Packaging the psa sheet stock in a cardboard box prevents the purchaser from seeing the contents without removing the lid. Also, cardboard tends to attract moisture and transfer it onto the psa sheet stock, thereby tending to cause the psa sheet stock to curl. Curling makes it difficult for the printer to use the psa sheet stock properly during printing. Curling also inhibits the proper application of the psa sheet stock after printing.

When cardboard boxes of psa sheet stock change hands during the course of reaching the end user, various labels and graphics are placed on the outside of the box. The contents of a box cannot be seen without removing the lid, and the labels or graphics placed thereon may not be consistent with the box's contents. Thus, when an end user wants to determine what is in a box, he or she will have to remove the box's lid to assure its contents are consistent with the labels and graphics placed thereon. Also, removal and replacement of labels and graphics on the container is often desired by subsequent users. Cardboard does not allow labels and graphics to be removed without undue effort and possible damage to the cardboard box.

In order to allow the contents of cardboard boxes to be seen, recently it has sometimes been a practice to cut a small window, say ½ inch by one inch, in the boxes, thus giving limited visibility of the contents. However, this then generally requires polywrapping of the contents to protect them against dust and moisture, both of which have readier access through the window than through the paper itself.

In general, neither the polywrap nor the cardboard box provides continuous protection of the psa sheet stock against exposure to moisture, nor do they combine reusability with the ability to see through the package. They do not give printers a reusable pack, and they do not give the end user a package he or she can use.

SUMMARY OF THE INVENTION

The invention provides a method and container for packaging printable pressure-sensitive adhesive sheet stock. The preferred embodiment of the present invention provides a method and container for packaging the psa sheet stock so that it is protected against moisture, and so that the paper merchant can display such stock, and so that the printer can also use the same container to display such stock, after printing, and also if desired after guillotining.

The container is generally rectangular and has a depth such that the closed container has zero ullage (the amount the container lacks of being full) when filled with a standard count (usually 200 or 100) of psa sheet stock of average caliper. That is, the container is substantially full so that, with the bottom piece of the psa sheet stock resting on the bottom of the container, the top piece abuts the inside of the container's cover when the cover is closed.

This allows a substantially full container to support one or more containers stacked thereon. Also, the cover of the container is hubbed, in a manner to be described, both to provide interlocking stability when a number of containers are stacked on each other, and to provide a snap closure around the entire perimeter of the cover, including the hinged edge of the cover.

The container lid, walls and bottom are slightly flexible, so the supported, stabilized relationship of stacked containers holds even if the paper caliper is greater or less than average caliper by several percent, thus in a sense causing one or more containers to be slightly "overfilled" or "underfilled." That is, the caliper of the psa sheet stock may vary by several percent without serious adverse effect on the support of one container by another, or the interlocking stability of the stack.

Thus, several containers can be stacked upon one another in a stable manner during shipping, storage, or while on display. The snap closure is provided by the interaction of the cover's hubbed portion with the base of the container.

The container is transparent and clear to allow visual inspection of its contents without the necessity of opening the cover. This feature allows paper merchants or printers to display printed psa sheet stock within the container, thereby allowing purchasers to see the contents without opening the cover. It also allows for a quick visual inspection of the remaining quantity of psa sheet stock to determine whether it is time to re-stock or print more of a particular item.

The transparent and clear material is moisture resistant to protect the psa sheet stock during shipping and storage. Furthermore, the material provides a relatively rigid molded container capable of withstanding the rigors of handling and shipping the psa sheet stock through the chain of distribution. The durability of the container allows it to be reused throughout the course of its usable life.

The container is also provided with a hinged recloseable cover which allows easy access to the container's contents but is capable of snap closure around the entire cover perimeter including the hinged edge, thus maintaining good protection against moisture (and dust) in the closed position.

The transparency of the present container allows inserts to be used for identifying the contents of the container and identifying the supplier of the contents. Such inserts can be readily removed and replaced with other inserts, or with labels, down the line of distribution, as desired. Also, contents may be seen regardless of what inserts or labels represent provided the inserts or labels do not cover the entire package.

The features of the container are also advantageous because, in those lines of distribution mentioned above in which small printers go to paper merchants to purchase bundles of psa sheet stock, the paper merchants have in their inventory psa sheet stock from various manufacturers. A printer visiting the paper merchant can readily see and compare stocks packaged according to the invention, while he cannot as readily examine and compare stocks that are conventionally packaged. Furthermore, the printer can observe the display, recloseability, and reusability features of the container, and the fact that he will be able to use his own identifying inserts, if desired. The container is therefore a purchase "premium" to the printer. In these respects, the use of the container gives both the manufacturer of the stock and the paper merchant a competitive advantage in moving goods.

The recloseability of the container allows printers to open the container, remove as much psa sheet stock as they need, print something thereon, and then place the psa sheet stock back in the container. The printer can then either display the printed psa sheet stock in the transparent and clear container, or ship the printed psa sheet stock to customers. When printed psa sheet stock is displayed within the transparent container, customers can open the container, remove as much printed sheet stock as they desire, and reclose the container. The recloseability provides convenient access to the contents of the container while simultaneously providing continuous protection of the psa sheet stock from humidity or other damage.

Additionally, customers purchasing printed psa sheet stock from a printer can reuse the transparent and clear container to transport the psa sheet stock. The container may also be re-used by the customer to display the psa sheet stock if necessary.

These advantages to the printer's customers give printers who use the containers a competitive advantage in selling printed psa sheet stock. The durability of the container allows it to be reused as required or desired for shipping, handling, storage or display by the paper merchant, the printer, the printer's customer, and anyone else in the chain of distribution, as may be desired.

The construction and arrangement of the transparent and clear container is such that a recloseable cover is mounted on a hinge at one short side of the container's base. The cover and base each has its own flange around its perimeter, and the outer edge of each of these flanges preferably consists of a planar portion. The cover flange also has a hubbed portion including a positive-draft guiding section defining a guiding hub and a negative-draft locking section defining a locking hub. The base flange has an offset section which acts as a stop when contacted by the offset section of the cover flange.

The base flange also has a negative-draft section which receives the negative-draft locking section of the cover flange. The joinder between the negative-draft section of the base flange and the planar portion of the base flange defines a detent edge extending around the perimeter of the base. When the cover is closed and snapped shut around its perimeter, a generally continuous closure is created by the interaction of the base flange and the cover flange.

The container may be economically formed by the vacuum molding process. Consistently with that process, the walls of the base of the container have a slight draft angle, and the bottom corners tend to be rounded. In order to prevent the edges and corners of the psa sheet stock from curling by laying against the bottom corners of the container, platform means is provided at the base's bottom so the psa sheet stock lays flat. The platform means is defined by a plurality of channels which provide additional strength to the container.

When the containers of the invention are stored on shelves they are generally stored lengthwise running from the front of the shelf to the back. With the hinge on the back of the container rather than one of the sides the containers can be more densely packed per unit length of shelf when stored, thereby taking up the least amount of shelf space.

DETAILED DESCRIPTION OF AN EXAMPLE OF THE INVENTION

Figure 1:
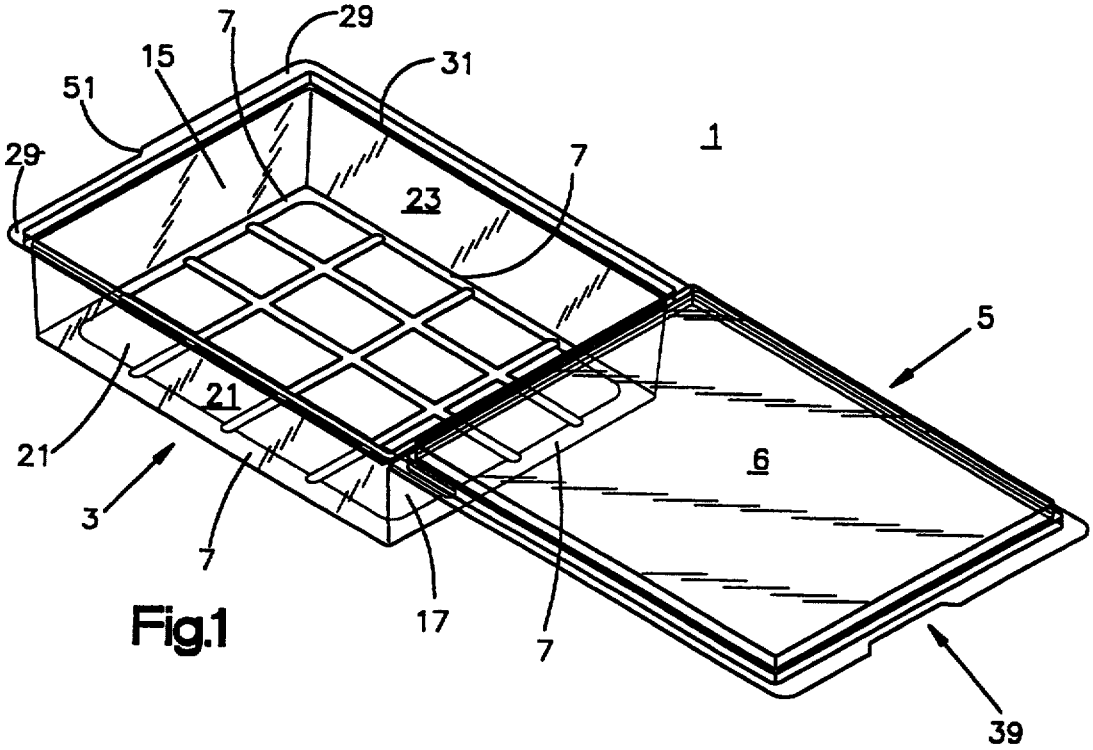
FIG. 1 is an isometric view of an empty container embodying the invention with the cover wide open.
Figure 6:
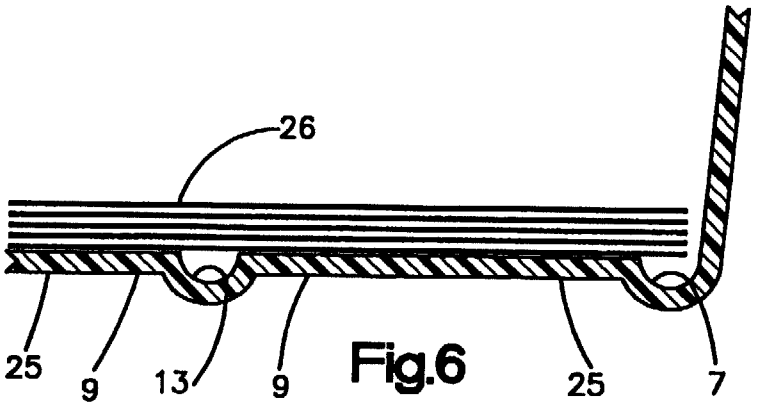
FIG. 6 is a fragmentary, cross-sectional view taken on the plane of line 6—6 in FIG. 3, but also diagrammatically showing a few sheets of psa sheet stock in the container. Again, thicknesses are exaggerated for clarity.

Referring now to the drawings, and in particular to FIG. 1, there is shown the container which is generally referred to by reference numeral 1. The container 1 is substantially rectangular, having a base 3 and a cover 5 which are engageable and closable with each other by snap action around their entire perimeters. The container 1 is preferably formed of 40-gage non-pigmented virgin polyvinyl chloride sheet stock to the following nominal dimensions: length—11 inches, height—2¾ inches, and width—9 9/16 inches. Various molding techniques are known which could be used to form the container 1. The preferred vacuum molding process is economical and typically results in rounding of the outside bottom corners or edges 8 along the length and width of the base 3, as best seen in FIG. 6. Also, a border channel 7, best seen in FIG. 6, is formed during molding. The border channel 7 extends around the perimeter of the bottom 9 of the base 3.

Figure 2:
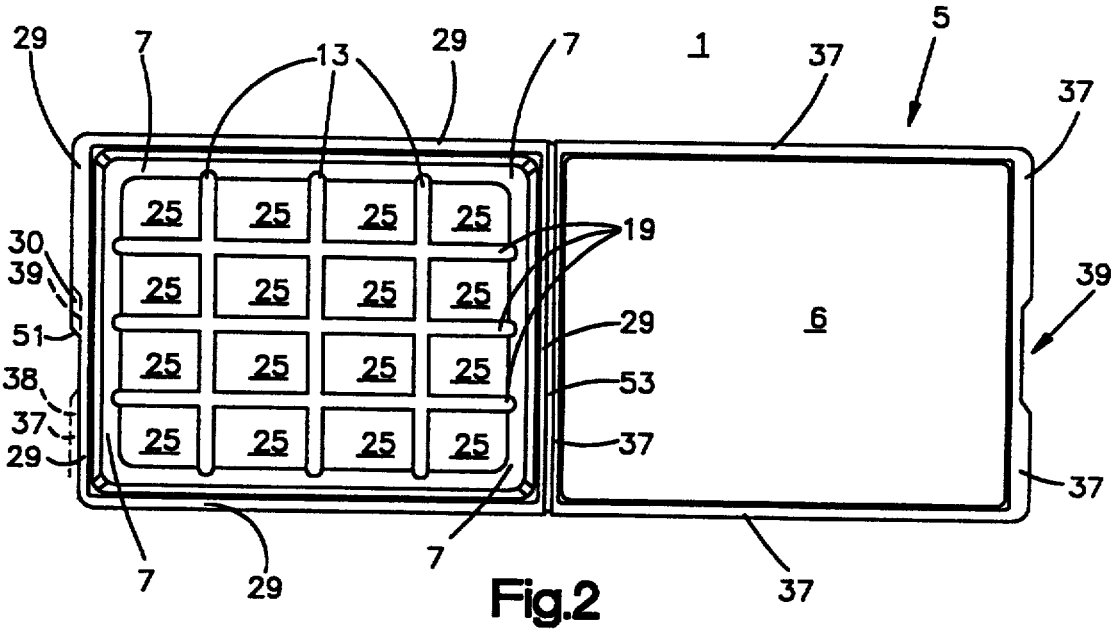
FIG. 2 is a plan view of same container again with the cover wide open, but also showing in phantom view certain elements of the cover in closed position.

Referring to FIG. 2, the bottom 9 includes a rectangular array of intersecting channels 19 and raised pads 25. This array is bounded by border channel 7. The array has a generally waffled configuration and includes a series of channels 13 which are parallel to the end walls 15 and 17. Another series of channels 19 is provided which are parallel to side walls 21 and 23.

Between the series of channels 13 and 19 are a multiplicity of raised pads 25. The raised pads 25 provide a substantially flat surface upon which the psa sheet stock 26 rests, as best shown in FIG. 6. The stock 26 overhangs the raised pads 25 which are contiguous to the border channel 7. This occurs on all four sides of the psa sheet stock 26, so the stock is held slightly above the curved outside bottom corners or edges 8, and the edges and corners of the lowermost sheets of stock 26 cannot be curled or bent by contact with the curved edges 8.

Figure 3:
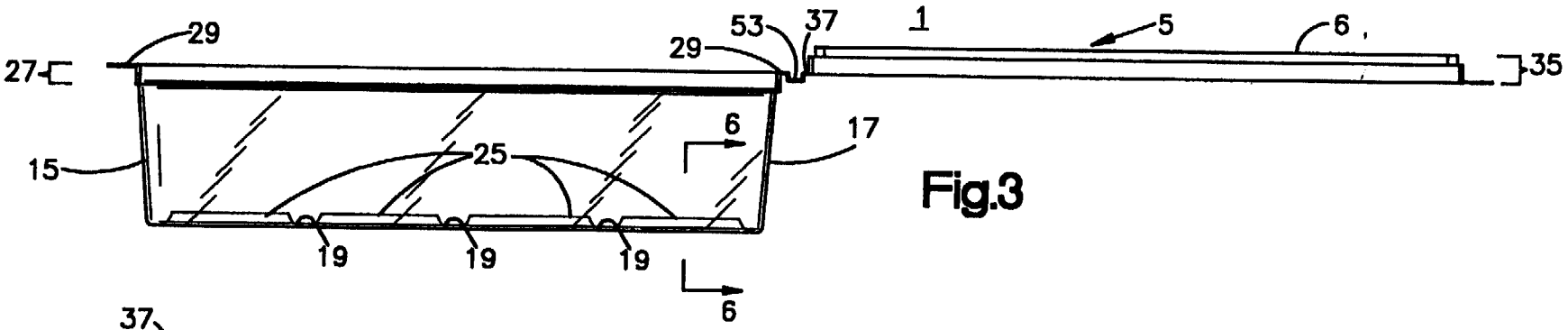
FIG. 3 is a side view of the same container.

Referring now to FIGS. 1 and 3, the base 3 has two end walls 15 and 17, and two side walls 21 and 23, all extending upwardly from the border channel 7 and forming slightly rounded corners at their intersections. The end walls 15 and 17, and the side walls 21 and 23 are preferably disposed with a draft angle of 4 degrees, for example, to achieve economical and proper molding without an unnecessary increase in the size of the container.

Figure 5:
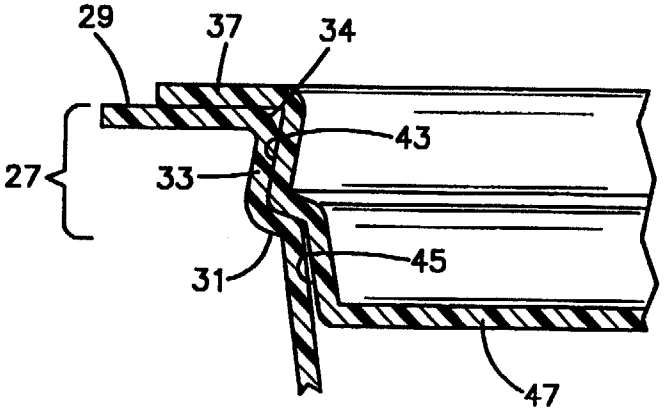
FIG. 5 is fragmentary, cross-sectional view similar to FIG. 4 but showing the base flange as well as the cover flange in the closed position.

A base flange 27 (FIGS. 3, 5) extends around the perimeter of the base at the upper edges of the end walls 15 and 17, and the side walls 21 and 23. Referring to FIG. 5, there is shown a cross-section of the base flange 27 with its thickness exaggerated for clarity. The base flange 27 includes a planar portion 29 having two widths, as best shown in FIGS. 1 and 2. The two widths of the planar portion 29 assist in opening the cover 5 as more fully described below. A base offset section 31 runs laterally from the side and end walls 15, 17, 21, and 23 to a negative-draft section 33 of the base flange 27. The base offset section 31 essentially forms a ledge on the inside of the base flange 27. The negative-draft section 33 joins the planar portion 29 at a detent edge 34, as best shown in FIG. 5.

Figure 4:
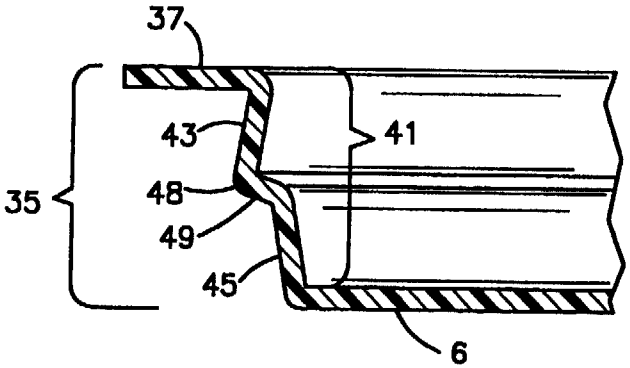
FIG. 4 is a fragmentary, cross-sectional view of the cover flange of the same container, shown on an enlarged scale, and with thicknesses exaggerated for clarity. In this view only a fragment of the cover is shown. The orientation of the cover corresponds to its closed position.

A cover flange 35 (FIG. 4) extends around the perimeter of the cover 6. The cover flange 36 includes a planar portion 37. At the front end of the cover, the planar portion 37 has a notch 39 formed therein, as best shown in FIGS. 1 and 2. The notch 39 and the planar portion 37 of the cover flange 36 cooperate with the planar portion 29 of the base flange 27 to facilitate opening the cover 6, as more fully described below. The cover flange 35 includes a hub portion 41 which includes a negative-draft locking section 43 defining a locking hub and an positive-draft section 46 defining a guiding hub. The section 45 extends from the cover proper 47 to an offset section 49. The offset section 49 runs laterally from section 45 to the negative-draft locking section 43 to which it is joined at a detent edge 48.

The cover flange 36 and the base flange 27 are constructed and arranged so that a generally continuous nesting or closure is created between the cover 5 and the base 3 when the cover 5 is closed. The nesting relationship is such as to substantially inhibit the ingress of moisture, but need not establish a hermetic seal, and usually does not. The negative draft of the section 43 may be, for example, 5 degrees. As the lid is closed, the detent edge 48 of the lid snaps past the detent edge 34 of the base and the locking hub 43 and offset section 48 snap into a nesting relationship, more or less, with the sections 33 and 31 of the base.

Since the walls are most strongly supported against sideward spreading at the corners of the container, the snap action may be most pronounced at the corners as the lid is closed. This detenting and snap action also tends to extend at least a limited distance from each corner along the base and cover flanges 27 and 35, to thereby nest the sections 43 and 40 into the sections 33 and 31 at least at those regions.

The nesting of flange elements of the lid and base as shown in an idealized manner in FIG. 5; in practice the angularity of adjacent elements such as 33 and 42 or 31 and 49 may differ somewhat so that there is not continuous contact throughout their vertical extents as shown. Nevertheless, the nesting relation is sufficient to establish continuous contact between the flanges along the lengths of the regions of nesting.

The material of the container is stiff enough that such nesting at the corner regions is sufficient to establish acceptable closure even midway between corners along the lengths of the end walls 15, 17 and side walls 21, 23, even though nesting at such midpoints may be relatively loose and the cover and base flanges at these locations may be only closely positioned adjacent each other rather than in actual contact.

It is to be noted that the cover and base flanges 35 and 27 extend around all four sides, including the hinge end of the container. Thus, at the hinge end, the planar portion 29 of the base flange 27 extends along the entire length of the end wall 17 inboard of the hinge 53, as most clearly seen in FIGS. 2 and 3. As seen in the same figures, the same is true of the planar portion 37 of the lid flange 35. The other elements of the base and cover flanges are still further inboard, and so they also extend along the entire length of the wall inboard of the hinge in the closed condition of the container. Thus, the seal can indeed extend in this manner along the hinge side of the container much as it extends along the other sides.

After the cover is lowered, closing of the container can conveniently be completed by using the thumb and forefinger to grasp the planar portions 29 and 37 and press them together to snap the container fully closed. For example, this can be done at the two front corners of the container using the thumb and forefinger of each hand, and the process can then be repeated at the two rear corners. If points midway between the corners require further closing, the planar portions 29 and 37 at those locations can be squeezed together also.

As previously mentioned, the planar portion 29 of the base flange 27 includes two widths, the outside edges of which are joined by a transverse edge 51, as best shown in FIGS. 1 and 2. When the cover 6 is closed the planar portion 37 of the cover flange 35 overlies the planar portion 29 of the base flange 27. The transverse edge 51 is aligned within the notch 39 each other so that when the planar portions 29 and 37 are overlying, the canted section 51 and part of the planar portion 29 are exposed within the notch 39. Furthermore, the planar portion 37 is wider than the narrower width of planar portion 29 so that opposing forces can be exerted on those portions, respectively, by thumb and index finger of one hand, thereby breaking the seal or seals around the rim and opening the lid.

Other arrangements can be provided, but the important relationship from the standpoint of opening convenience is that the flange portions 29 and 37 of the base and flange are arranged so that when the container is closed, there is at least one region where the upper flange portion has its lower face exposed, as at region 38 of upper flange portion 37 (FIG. 2), and at least one region where the lower flange portion has its upper face exposed, as at region 30 of lower flange portion 29 (FIG. 3), and these respective regions of exposure occur adjacent each other along the length of the front or end wall 15, These can be conveniently grasped with the thumb and forefinger and squeezed to prize the cover and base flanges apart and release them from each other at the front of the container. Lifting of the cover then readily causes release of the flanges at the remaining portions of the container.

The hinge 53 is preferably given some width, as best seen in FIG. 3, so that it can flex somewhat to accommodate relative snap action motion between the cover and base flanges 35 and 27 as the container is closed. The hinge 53 connects the cover 5 and the base 3, at the base wall opposite to notch 39, that is, to end wall 17 in the illustrated container. As shown, the hinge 53 and notch 39 are preferably associated with the opposed end walls of the base, rather than with its opposed side walls. In this manner, when a multiplicity of containers are placed along a shelf with their lid fronts facing forward for most convenient opening, the containers can be more densely packed per unit length of shelf, thereby maximizing shelf space.

The cover 5 is constructed so that the cover proper 6 forms a plane which is spaced from and parallel to the plane formed by the planar portion 37, as best shown in FIG. 3. When the container 1 is situated in a horizontal upright position and the cover 5 is closed, the plane formed by the cover proper 6 lies beneath the plane formed by the planar portion 37. Thus, the cover flange 35 defines a shallow rectangular recess that receives border channel 7 of the rectangular bottom 9 of an identical container stacked thereon in a manner that stabilizes the stacked containers against horizontal forces. If a multiplicity of containers are stacked upon each other, channels 7, 9 and 13 of the bottom of one container rest upon the cover proper 6 of the container below it. Preferably, the cover proper 6 and the cover flange 35 are proportioned to snugly receive border channel 7 of the bottom 9 of an identical container, thus providing a tight interlocking effect preventing and lateral sliding of one container relative to the other.

The container 1 may be vacuum form molded by well-known techniques from, preferably, non-pigmented virgin polyvinyl chloride sheet stock. The material is moisture resistant and transparent, so that the contents of formed and filled containers may be seen without opening the cover 5. The material as molded is relatively rigid, but is capable of yielding for snap-action closing and is capable of readily flexing along a hinging joint such as the hinge 53, and is adapted to endure the rigors of shipping and handling.

The method of packaging the psa sheet stock of a given nominal thickness includes the steps of providing the manufacturer of the psa sheet stock with the container 1 matched to a given standard sheet count, for example a count of 100 or 200 sheets of psa sheet stock, each sheet comprising the printable facestock itself, the coating of psa, and the release liner for protecting the psa. The container 1 is proportioned for stock of average caliper so that the top sheet of psa sheet stock abuts the lower surface of the cover proper 6, and the bottom sheet rests upon the raised pads 25. This allows stacked containers to be supported by the fill of the psa sheet stock in the container located thereunder. If the psa sheet stock in a container is, say, two or three percent thinner or thicker than average caliper, the cover 5 and waffled bottom are resilient enough so they will conform to the fill of psa sheet stock in the container 1, and the supporting relationship between containers in a stack is maintained.

The paper manufacturer may put removable inserts in the container to designate or describe the stock. These, as well as the stock itself, are visible from the exterior of the container. The inserts may be color-coded or printed in any manner.

Sometimes the filled containers are shipped directly to a printer, but it is more customary in the industry to ship them to a paper merchant first who may deliver them to a printer from stock or hold them and display them in stock for pick-up by a printer. Once the container reaches the printer's shelf, the printer can remove as much psa sheet stock as needed, print it, then return it to the container for storage, display, and subsequent distribution. The printer may guillotine the stock into separate labels which may then be shrink-wrapped in individual packs and replaced in the container. The printer may simply remove any previously provided color-coded or printed inserts and may provide his own labels or inserts on or in the container.

While the invention has been shown and described with respect a to particular embodiment, this is for the purpose of illustration rather than limitation, and other variations and modifications of the disclosed embodiment will be apparent to those skilled in the art all within the intended spirit and scope of the invention. Accordingly, the patent is not to be limited in scope and effect to the specific embodiment herein shown and described nor in any other way that is inconsistent with the extent to which the art has been advanced by the invention.

What is claimed is:

1. A package including a container and a stack of psa sheet stock in the container, the sheets of the psa sheet stock having a rectangular shape formed by straight edges, said container being formed of molded sheet material, said container being generally rectangular and comprising a base with relatively long side walls, relatively short end walls, and a bottom wall, a cover hinged to the base, said bottom wall of said base comprising a bottom wall proper framed by border channels extending downwardly to an imaginary bottom plane, said bottom wall proper providing platform means surrounded by said border channels, said side walls and end walls being substantially upright and being planar throughout the majority of their height and said planarity extending downward below the level of said platform means, the outer sides of said border channels forming downward extensions of said side walls or end walls, the border channels being rounded in section with relatively large radii and being substantially exclusively below the platform means, the edges of the sheet stock overlying said channels whereby any tendency of the sheets to curl at their edges is reduced.

2. A package as in claim 1 in which said bottom wall proper is reinforced and divided into a plurality of platforms by a grid of intermediate channels located inboard of said border channels.

3. A package as in claim 2 in which said cover is indented from the top to define a concave rectangular hub having a central wall constituting the cover proper, said cover proper being spaced from said platform means by a distance equal to a the total thickness of a standard count of packaged psa sheet stock.

4. A package as in claim 2 in which said the side walls and end walls of said base taper inwardly at a shallow draft angle to said border channels, and said cover is indented from the top to define a concave rectangular hub having a central wall constituting the cover proper, said concave hub forming a socket to receive the frame formed by said bottom channels of a like container.

5. A package as in claim 4, said cover proper being spaced from said platform means by a distance equal to a the total thickness of a standard count of packaged psa sheet stock.

6. A stack of a plurality of containers as defined in claim 5, each container being filled with a standard count of packaged psa sheet stock, and all containers in the stack but the bottom one being at least partly supported directly or indirectly by the sheet stock contained in lower containers, and adjacent containers in the stack being interlocked against relative lateral movement by the engagement between said frame of one container and socket of the other.

7. A package as defined in claim 5, said cover being hinged to said base at one of said end walls.

8. A package as in claim 1 in which said the side walls and end walls of said base taper inwardly at a shallow draft angle to said border channels, and said cover is indented from the top to define a concave rectangular hub having a central wall constituting the cover proper, said concave hub forming a socket to receive the frame formed by said bottom channels of a like container.

9. A package as in claim 8, said cover proper being spaced from said platform means by a distance equal to a the total thickness of a standard count of packaged psa sheet stock.

10. A package as in claim 1 in which said cover is indented from the top to define a concave rectangular hub having a central wall constituting the cover proper, said cover proper being spaced from said platform means by a distance equal to a the total thickness of a standard count of packaged psa sheet stock.

11. A package as in claim 10 in which said standard count is 200.

12. A package as in claim 10 in which said standard count is 100.

13. A stack of a plurality of containers as defined in claims 10, each container being filled with a standard count of packaged psa sheet stock, and all containers in the stack but the bottom one being at least partly supported directly or indirectly by the sheet stock contained in lower containers.

14. A package as defined in claim 1, said cover being hinged to said base at one of said end walls.

15. A package including a container and psa sheet stock in the container comprising a base and cover, said base formed of molded sheet stock by an economically efficient molding process, said process resulting in a border channel being formed in said base which defines a bottom perimeter of said base, said base including two end walls and two side walls extending from said border channel which form at their intersection with each other and said border channel a plurality of rounded corners, a raised bottom portion for supporting the psa sheet stock above said border channel and said rounded corners, the edges of the sheet stock overlying said border channel whereby a tendency of the edges of the psa sheet stock to curl on the walls of the base is avoided.

16. A package as recited in claim 15 wherein said raised bottom portion includes a plurality of channels formed therein for providing rigidity to said end and side walls of said base.

17. A package as recited in claim 16 wherein said plurality of channels forms a waffle pattern whereby a first series of spaced apart channels is parallel to said side walls and a second series of spaced apart channels is parallel to said end walls so that a plurality of raised pads is formed between said spaced apart channels.

18. A package including a container and a stack of psa sheet stock in the container, said container being formed of molded sheet material, said container being generally rectangular and comprising a base with relatively long side walls, relatively short end walls, and a bottom wall, a cover hinged to the base along one of the walls, the side walls and end walls of said base tapering inwardly at a shallow draft angle, base flange means extending around the perimeter of said base at the top edges of said side walls and end walls including along the wall edge at which said cover is hinged to the base, cover flange means extending around the perimeter of said cover including along the cover edge at which said cover is hinged to the base, said base flange means and cover flange means including respective detent means that are coextensive with the flange perimeters and extend, with said perimeters, along said wall and cover edges at which said cover is hinged to the base and further including planar flange means that are coextensive with the flange perimeters and extend, with said perimeters, along said wall and cover edges at which said cover is hinged to the base and further including planar flange means that are coextensive with the flange perimeters and adapted to be squeezed together from above and below when the cover is near its closed position to engage said detent means and establish closure around the perimeter of the cover including the portion thereof at said hinge to thereby fully close the cover, the stack of psa sheet stock resting on the top of the bottom wall and directly underlying the lower face of the cover when the cover is closed, the cover being constructed and arranged to receive the bottom of an identical container at a plane below the closure and thereby transfer the weight of psa sheet stock contained in it and the weight of additional superposed identical packages to the stack of psa without adversely affecting the engagement of the detent means and closure on the perimeter of the cover, said bottom wall of said base comprising a bottom wall proper framed by border channels extending downwardly to an imaginary bottom plate, said bottom wall proper providing platform means surrounded by said border channels, the outer sides of said border channels forming downward extensions of said side walls or end walls.

* * * * *